US011380479B2

(12) United States Patent
Marrs et al.

(10) Patent No.: US 11,380,479 B2
(45) Date of Patent: Jul. 5, 2022

(54) HIGH VOLTAGE IGNITION COIL WITH IMPROVED INSULATING CHARACTERISTICS

(71) Applicant: MARSHALL ELECTRIC CORP., Rochester, IN (US)

(72) Inventors: Thomas C. Marrs, Rochester, IN (US); Donald Recupido, Argos, IN (US)

( * ) Notice: Subject to any disclaimer, the term of this patent is extended or adjusted under 35 U.S.C. 154(b) by 508 days.

(21) Appl. No.: 16/440,517

(22) Filed: Jun. 13, 2019

(65) Prior Publication Data

US 2020/0395170 A1 Dec. 17, 2020

(51) Int. Cl.

| | |
|---|---|
| ***H01F 27/32*** | (2006.01) |
| ***H01F 38/12*** | (2006.01) |
| ***H01F 41/082*** | (2016.01) |
| ***H01T 13/44*** | (2006.01) |
| *H01T 15/00* | (2006.01) |
| *H01F 5/02* | (2006.01) |

(52) U.S. Cl.

CPC ..... *H01F 38/12* (2013.01); *H01F 27/325* (2013.01); *H01F 41/082* (2016.01); *H01T 13/44* (2013.01); *H01F 2005/022* (2013.01); *H01T 15/00* (2013.01)

(58) Field of Classification Search

CPC ..... H01F 38/12; H01F 27/325; H01F 41/082; H01F 2005/022; H01F 2038/122; H01T 13/44; H01T 15/00

See application file for complete search history.

(56) References Cited

U.S. PATENT DOCUMENTS

| | | | |
|---|---|---|---|
| 4,580,122 | A | 4/1986 | Worz |
| 4,684,912 | A | 8/1987 | Kiltie et al. |
| 5,938,143 | A | 8/1999 | Yukitake |
| 6,417,752 | B1 | 7/2002 | Heritier-Best et al. |
| 7,969,268 | B2 | 6/2011 | Dal Re et al. |
| 10,107,251 | B2 | 10/2018 | Marrs et al. |
| 2003/0106956 | A1 | 6/2003 | Moga et al. |

FOREIGN PATENT DOCUMENTS

| | | | | |
|---|---|---|---|---|
| DE | 19711815 | A1 * | 9/1998 | ..... H01F 5/02 |
| KR | 10-1144654 | B1 * | 5/2012 | |

* cited by examiner

*Primary Examiner* — Tuyen T Nguyen

(74) *Attorney, Agent, or Firm* — Egbert, McDaniel & Swartz, PLLC

(57) ABSTRACT

An ignition coil has a ferromagnetic core with a primary coil surrounding a first portion of the ferromagnetic core and a secondary coil surrounding the second portion of the ferromagnetic core. The secondary coil is wrapped around a bobbin. The bobbin has an interior receiving the second portion of the ferromagnetic core. A form is interposed between the secondary coil and the second portion of the ferromagnetic core. The form extends longitudinally along the second portion of the ferromagnetic core. The form is of a non-ferrous metal material.

14 Claims, 3 Drawing Sheets

Patent secondary side structure circular form without frame

HIGH VOLTAGE IGNITION COIL WITH IMPROVED INSULATING CHARACTERISTICS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to high-voltage transformers. More particularly, the present invention relates to such high-voltage transformers used in ignition systems for internal combustion engines. More particularly, the present invention relates to a configuration of a secondary coil of the ignition coil and the ferromagnetic core of the ignition coil.

2. Description of Related Art Including Information Disclosed Under 37 CFR 1.97 and 37 CFR 1.98

Ignition coils have primary and secondary wire wound bobbin assemblies with a ferromagnetic core in order to provide flux linkage between the magnetic source and the magnetic load. The assembly is typically encapsulated in a dielectric material to provide a limited insulation and prevent external contamination that could lead to premature failure. The insulating materials currently used in ignition coils are stressed at increased temperatures and higher voltages. The windings on the primary bobbin will have a sufficient number of turns to develop the required magnetic flux density to provide the desired energy to the coupled to secondary side. The secondary bobbin windings will a sufficient number of turns to induce a high-voltage of desired amplitude and duration (typically greater than 20,000 volts for an ignition coil). The high-voltage is then transferred to the spark mechanism by a joining method in order to ignite the fuel in the cylinder in order to rotate the engine crankshaft.

High-voltage transformers for ignition systems in modern internal combustion engines generally include a tubular winding form that receives a ferromagnetic core (generally of a laminated construction), primary winding surrounding the core and secondary windings wrapped around the winding form. The transformers generally capable of producing a secondary voltage of around 30 KV or more.

The winding form usually has a plurality of axially spaced annular partitions that define annular chambers therebetween. The turns of the secondary windings are wound in the first chamber at one end until the chambers build to a desired level. Then, the windings proceed to the next chamber such as by passing the wire through a helical transition slot formed in the respective partition and then filling the next adjacent chamber to the same level. This process is continued until all of the chambers are filled progressively from one end to the other. The actual winding of the secondary coil is usually accomplished with automatic coil winding equipment.

In modern ignition systems, higher energy coils and spark gaps are being used (e.g. such as in the range of 0.05 inches and higher) in order to achieve better ignition of the fuel. As a result, higher sparking voltages are necessary, such as voltage in excess of 30 KV. The ignition coils are the subject to much greater voltage stress than in the past.

In order to accommodate this, several coils are used in the system, such as one coil for every one or two spark plugs. In the two spark plug configuration, one end of the secondary coil is connected to one plug and the opposite end is connected to the other plug which is set to fire at an opposite portion of the engine cycle.

One problem that can occur during operation of modern automotive ignition systems is sparking across adjacent coil turns during collapse of the transformer field at the firing point. The firing or arcing across the spark gap of the plug generates an RF voltage that may be reflected back to the secondary coil. This high voltage transient or spike may have a frequency of around 10 MHz. The resulting RF energy is quickly dissipated in the first three or four turns of the secondary coil, however, the high RF voltage does present a danger of arcing in the first few turns of the closely coupled wire. In fact, arcing from one end turn to the next frequently does occur, resulting in deterioration of the insulation on the conductor and of the dielectric material in which the conductor is embedded. This can also occur on those coil-on/over plug-type coil assemblies.

Testing has been accomplished on these coil ignition systems in nitrogen atmosphere pressure vessels under conditions that simulate actual engine operation and with the voltage level adjusted to provide optimum sparking. The tests verify that the RF voltage spikes generated causes deterioration of the insulation of the first few turns of the coil and thus premature coil failure. The frequency and magnitude of the reflected RF signal is a function of the sparking voltage and the size of the spark gap.

It is been suggested that a solution to this problem is to enlarge the secondary coil form or bobbin to provide greater spacing between the end turns. The spacing should be sufficient to eliminate arcing. While this may be an effective solution, the enlargement of the coil form is often not possible because of the criticality of the various components of the engine compartment of the vehicle and, in particular, the ignition system components.

In the past, various patents have issued relating to such winding forms. For example, U.S. Pat. No. 4,580,122, issued on Apr. 1, 1986 to P. Worz, describes an ignition coil for ignition systems of internal combustion engines. In particular, the secondary winding and the coil body carrying the ignition coil are manufactured in a chambered realization. The radial extension (i.e. height) of each chamber winding decreases toward the higher chamber potential in accordance with the law of geometric progression so that the insulating distance between the secondary winding and the areas of the ignition coil that carry a lower potential increases with an increasingly higher chamber potential.

U.S. Pat. No. 4,684,912, issued on Aug. 4, 1987 to Kiltie et al., describes a winding form for a high-voltage transformer. This winding form includes a ferromagnetic core, a primary coil and a secondary coil. The secondary windings are wrapped on a tubular insulating winding form or bobbin with annular radial portions defining a plurality of annular coil chambers including a plurality of central chambers and at least one end chamber. The end chamber defines a spiral land that proceeds both axially toward the respective end and radially outwardly for three or more complete turns. The respective end turns of the coil wrap one turn of coil on each turn of the spiral land so that successive turns of the end portions of the secondary coil are both axially and radially spaced from one another sufficient to minimize arcing.

U.S. Pat. No. 5,938,143, issued on Aug. 17, 1999 to K. Yukitakae, shows an ignition coil winding method for spirally winding an element wire in conical banks of wire turns one by one around the coil bobbin. In particular, a nozzle is provided that can vertically move toward and away from the coil bobbin accordingly changing the winding radius and can swing in the direction normal to the longitudinal axis of the bobbin to maintain constant tension of the element wire.

U.S. Pat. No. 6,417,752, issued on Jul. 9, 2002 to Heritier-Best, shows an ignition coil of the type intended to be mounted on a spark plug for the individual electrical supply of the spark plug. This ignition coil includes an internal secondary winding, an external primary winding, a flux return shell, and a casing. The casing surrounds only the secondary winding. The primary winding is wound onto the casing on the outside of the casing. The flux return shell surrounds the casing.

U.S. Pat. No. 7,969,268, issued on Jun. 28, 2011 to Dal Re et al., provides an ignition coil configured for electrical communication with a spark plug of an internal combustion engine. The ignition coil has a primary spool and a secondary spool. The primary spool has a bore and an outer surface with a low-voltage winding supported thereon. The secondary spool has a cavity with a magnetic core received therein at a substantially cylindrical outer surface. The secondary spool is received at least partially in the bore of the primary spool. A high-voltage winding is supported on the outer surface of the secondary spool. The high-voltage winding has discrete winding sectors spaced from one another along the length of the secondary spool.

U.S. Patent Publication No. 2003/0106956, published on Jun. 12, 2003 to Moga et al., teaches a coil winding system for making a secondary winding of an automotive ignition coil. The system includes a roller configured to apply a folding force to the wire being dispensed from a wire nozzle onto a bobbin. The nozzle and the roller are removed by a drive mechanism under control of a controller from one axial end to the other axial end of the bobbin for winding the bobbin in a progressive winding fashion. The roller allows an increase in the winding angle of the layers so as to reduce the voltage difference between adjacent layers and thus reduce incidence of dielectric breakdown in that region.

U.S. Pat. No. 10,107,251, issued on Oct. 23, 2018 to the present Applicant, describes an ignition coil having a winding form. This ignition coil has a ferromagnetic core, a primary coil surrounding the portion of the core and wrapped helically with the conductor, a winding form having partitions extending outwardly of a tubular surface of the winding form, and a secondary coil wrapped on the winding form. The partitions define a plurality of annular coil chambers including central chambers and end chambers. The end chambers have a spiral land. The secondary coil includes coil sections in each of the plurality of coil chambers. The secondary coil has coil turns in the end chambers in a spiral configuration on the spiral land in increasing progressively in diameter toward the central chambers.

It is an object of the present invention to provide a secondary side of a high voltage ignition coil that improves the operating life of the ignition coil.

It is another object of the present invention to provide a secondary side of a high voltage ignition coil that reduces the potential difference of the electrical field internal to the ignition coil.

It is another object of the present invention to provide a secondary side of a high voltage ignition coil that reduces failure rates of the ignition coil.

It is another object of the present invention to provide a secondary side of a high voltage ignition coil that reduces localized charge density from high voltages.

It is still another object of the present invention to provide a secondary side of a high voltage ignition coil that more uniformly stresses the insulating material between the core of the ignition coil and the high voltage of the secondary side of the transformer.

It is still another object of the present invention to provide a secondary side of a high voltage ignition coil that significantly improves the coil's unloaded operating life expectancy.

It is another object of the present invention to provide a secondary side of a high voltage ignition coil that is relatively easy to manufacture and relatively inexpensive.

These and other objects and advantages of the present invention will become apparent from a reading of the attached specification and appended claims.

BRIEF SUMMARY OF THE INVENTION

The present invention is an ignition coil that comprises a ferromagnetic core, a primary coil surrounding a first portion of the ferromagnetic core, a secondary coil surrounding a second portion of the ferromagnetic core, and a form interposed between the secondary coil and the second portion of the ferromagnetic core. The form extends longitudinally of a length of the second portion of the ferromagnetic core. The form is of a non-ferrous material. The secondary coil is wrapped around a bobbin. The bobbin has an interior that receives the secondary portion of the ferromagnetic core and extends over the form.

In the present invention, the form extends substantially along the entire length of the bobbin. The bobbin has an inner wall facing the second portion of the ferromagnetic core. In one embodiment of the present invention, the form is affixed to the inner wall of the bobbin. Alternatively, the form can be affixed to the second portion of the ferromagnetic core located within the interior of the bobbin.

In one embodiment of the present invention, the form will have a generally tubular shape. This tubular shape has a split extending longitudinally therealong so as to interrupt a circularity of the tubular shape. In an alternative embodiment, the form is of a rectilinear shape. This form is positioned adjacent to the second portion of the ferromagnetic core.

A frame can be affixed to the exterior of the second portion of ferromagnetic core. This frame is of a non-metallic material. Alternatively, the frame can be interposed between the second portion of the ferromagnetic core and the form. Once again, this frame is of a non-metallic material.

The ferromagnetic core has a generally square or rectangular shape. The primary coil is positioned on one side of the ferromagnetic core and the secondary coil is positioned on opposite side of the ferromagnetic core. The ferromagnetic core, the primary coil, and the secondary coil are received within the interior of the housing.

In the present invention, the non-ferrous metal material used for the form is arranged and constructed in such a way that the insulating material is more uniformly stressed between the ferromagnetic core and the secondary winding or high-voltage side of the transformer. The non-ferrous material is configured in a circular or rectangular shape that surrounds a portion of the ferromagnetic core and the inner barrel of the high-voltage secondary side bobbin. The form can be isolated (as sown in FIG. 4) or joined to the ferromagnetic core (as shown in FIG. 5) in order to diminish dense electrical field points and provide a more uniform flux density. The surround form reduces surface charge densities on the smaller radius areas of the ferromagnetic core. This causes the insulation material to be more uniformly stressed. The internal form is separated on one side so as to not be connected in a closed loop with itself so that current cannot flow around the non-ferrous metal form. The present invention allows for increased potential voltages between the secondary side of the coil and the ferromagnetic core that would normally result in an electrical breakdown between the assembly components.

This foregoing Section is intended to describe the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
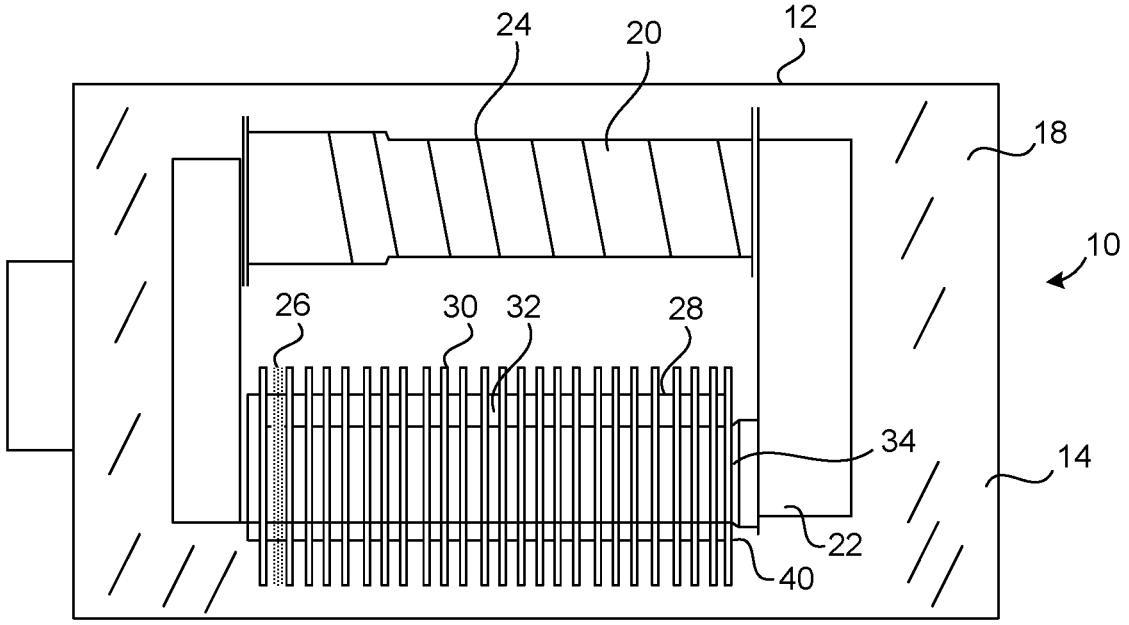
FIG. 1 is a side elevational view of the ignition coil of the present invention with the ignition coil housed in a housing.

FIG. 1 shows the ignition coil 10 in accordance with the teachings of the present invention. The ignition coil 10 has a housing 12 that has an interior 14 adapted to receive a ferromagnetic core 16. Typically, a potting material 18 encapsulates the interior 14 of the ignition coil 10. Typically, the potting material will be any of a number of dielectric materials which provides a limited insulation and prevents external contamination which could lead to premature failure of the ignition coil 10.

The ignition coil 10 has the ferromagnetic core 16 with a first side 20 and a second side 22. The ferromagnetic core 16 has a generally rectangular configuration. A primary coil 24 surrounds the first portion 20 of the ferromagnetic core 16. A secondary coil 26 surrounds the second portion 22 of the ferromagnetic core. In particular, it can be seen that there is a bobbin 28 that has an interior that is positioned over the opposite side 22 of the ferromagnetic core 16. In particular, the bobbin 28 has a plurality of bobbin flanges 30 that radiate outwardly from a central core 32. The secondary coil 26 is received in this plurality of bays defined by the bobbin flanges 30 and the central core 32. The secondary coil 26 is illustrated partially in FIG. 1. It is understood that the coils will be received in the plurality of bays of the bobbin 28. Importantly, there is a form 34 that will be interposed between the secondary coil 26 and the second portion 22 of the ferromagnetic core 16. This form 34 will be of a non-ferrous metal.

Figure 2:
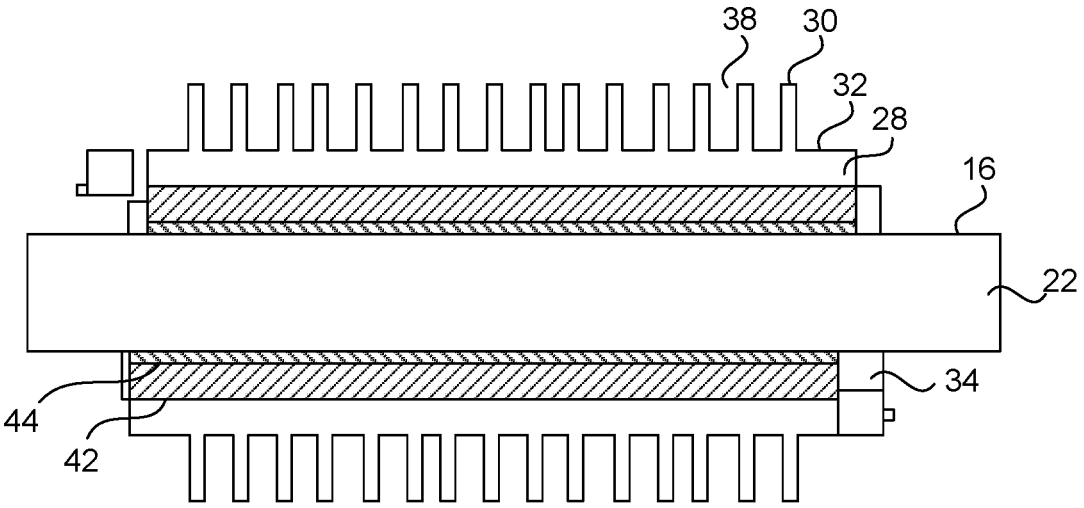
FIG. 2 is a side elevational cross-sectional view showing one embodiment of the ignition coil of the present invention.

FIG. 2 is an isolated view showing the second portion 22 of the ferromagnetic core 16 as received within the interior of the bobbin 28. It can be seen that the bobbin 28 includes a plurality of bobbin flanges 30 that define a plurality of bays 38. The bobbin flanges 38 are annular members that radiate outwardly from the core 32 of the bobbin 28. The secondary coil will be received in this plurality of bays 38 (as described hereinbefore).

Importantly, in FIG. 2, the form 34 is particularly illustrated as being interposed between the secondary coil and the second portion 22 of the ferromagnetic core 16. The form 34 extends longitudinally along a length of the second portion 22 of the ferromagnetic core 16. As stated hereinbefore, it is important that this form be of a non-ferrous metal. The form 34 extend substantially along the entire length of the bobbin 28. In FIG. 2, it can be seen that the form 34 is affixed to an inner wall 42 of the bobbin 34. However, within the concept of the present invention, the form can be placed in other locations, as described hereinafter. The form 34 will have a generally tubular shape. Importantly, the tubular shape will have a split extending longitudinally therealong so as to interrupt the circularity of the tubular shape so as to not be connected in a closed loop with itself. This prevents current from flowing around the non-ferrous metal form 34.

A frame 44 is illustrated as affixed to an exterior of the second portion 22 of the ferromagnetic core 16. The frame 44 will be of a non-metallic material. In an alternative embodiment, the frame 44 can simply be interposed between the second portion 22 of the ferromagnetic core 16 and the form 34.

Figure 3:
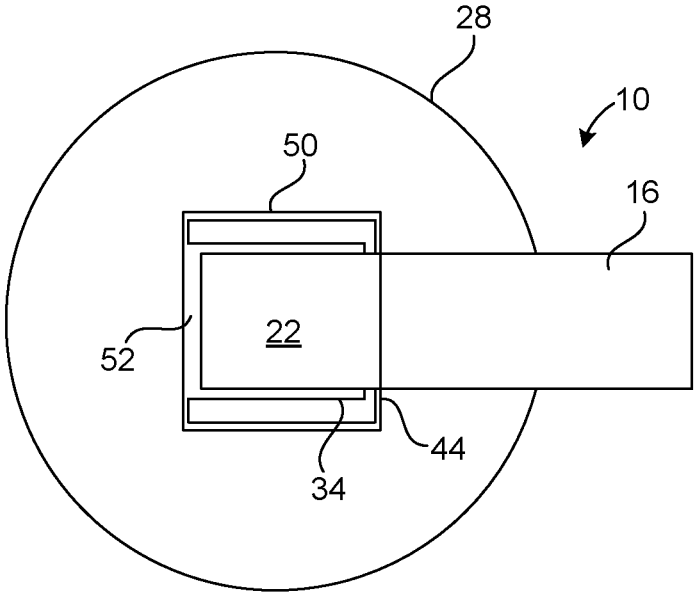
FIG. 3 is an end view of one embodiment of the ignition coil of the present invention.

FIG. 3 shows the secondary side of the ignition coil 10 of the present invention. The ferromagnetic core 16 is illustrated as extending into the interior of the bobbin 28. The interior of the bobbin 28 is of a generally rectangular or square shape 50. It can be seen that the form 34 will extend substantially around the exterior of the second portion 22 of the ferromagnetic core 16. There is a gap 52 in the shape of the form 34. The frame 44 is illustrated in FIG. 3 as being interposed between the form 34 and the exterior of the second portion 22 of the ferromagnetic core 16. If desired, the frame 44 can simply be affixed to the ferromagnetic core 16. This frame 44 is of a non-metallic material.

Figure 4:
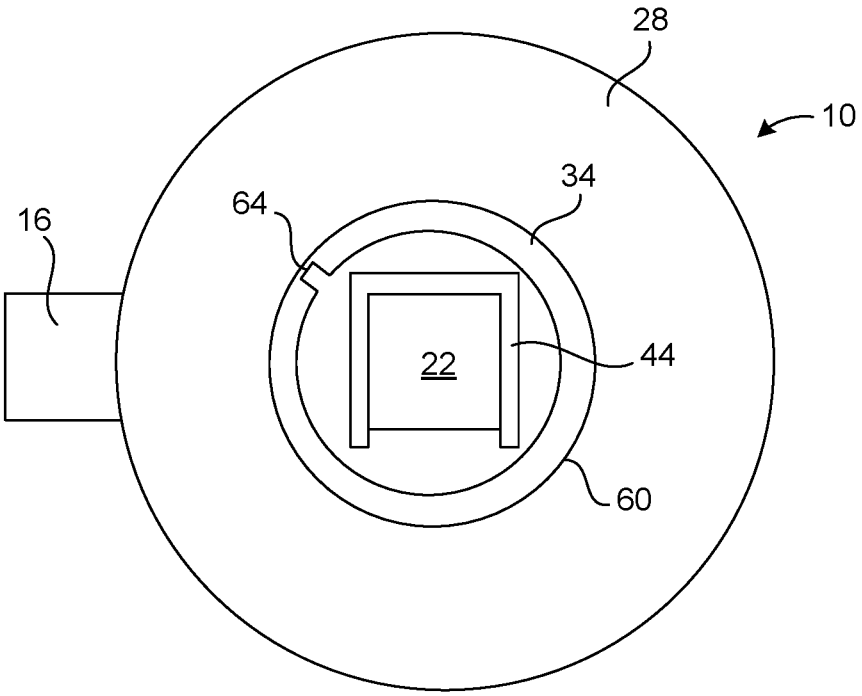
FIG. 4 is an end view of an alternative embodiment of the ignition coil of the present invention showing the form as isolated from the ferromagnetic core.

FIG. 4 shows the secondary side of the ignition coil 10 from an opposite end from that of FIG. 3. In FIG. 4, the bobbin 28 will have a circular or round interior 60. As such, the form 34 will have a generally circular or tubular shape which conforms to the circular wall 60 of the bobbin 28. The second portion 22 of the ferromagnetic core 16 is illustrated as located centrally within the interior of the form 34. A split 64 is formed in the circular shape of the form 34 so as to interrupt the circularity of the form 34. The non-metallic frame 44 is illustrated as positioned over the second portion 22 of the ferromagnetic core 16.

Figure 5:
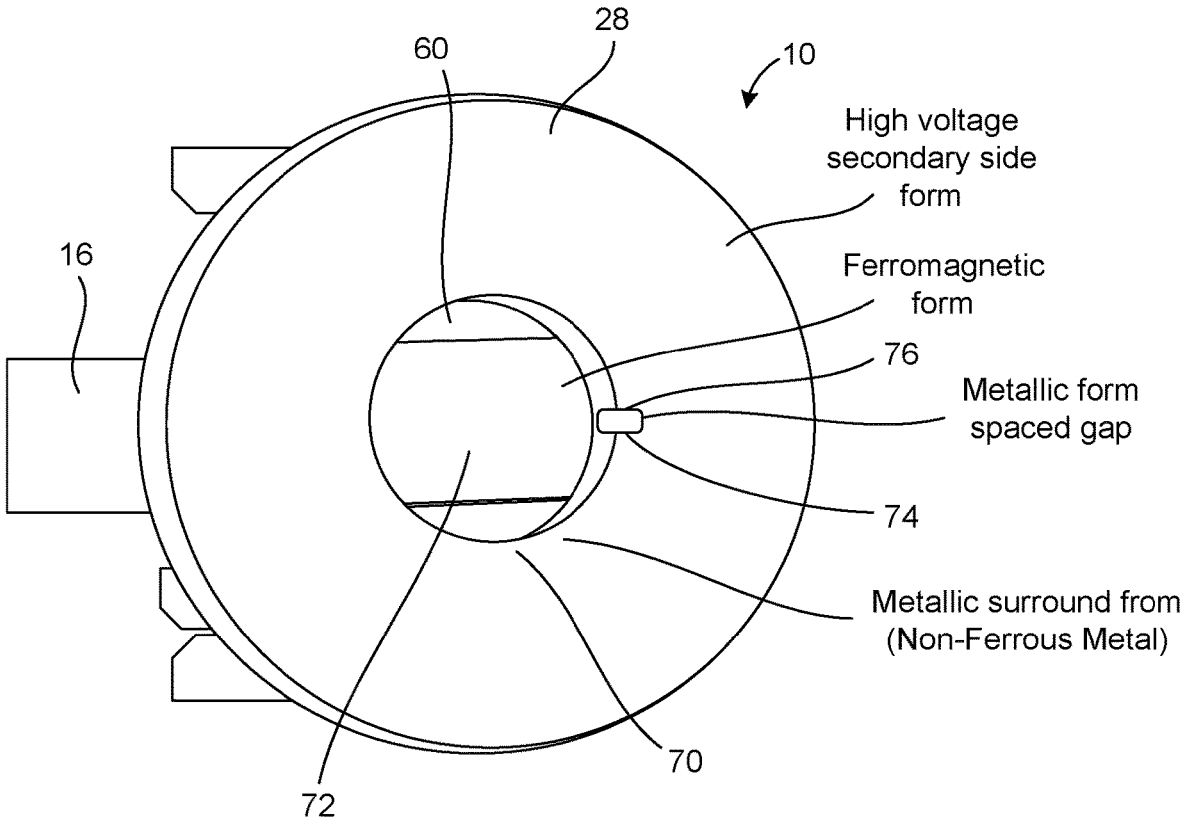
FIG. 5 is an end view of an alternative embodiment of the ignition coil of the present invention showing the form adjacent to the ferromagnetic core.

FIG. 5 shows an alternative embodiment of the secondary side of ignition coil 10 from an opposite end of that of FIG. 3. In FIG. 5, the bobbin 28 will have a round or circular interior 60. As such, the metallic surround form 70 will have a generally circular or tubular shape which conforms to the circular wall 60 of the bobbin and 28. The second portion 72 of the ferromagnetic core 16 is illustrated as located centrally within the interior of the metallic surround form 70. A spaced gap 74 is shown in the metallic surround form 70. A metallic piece 76 is located in this split 74. The metallic piece 76 in the spaced gap 74 interrupts the circularity of the metallic surround form 70. Unlike the embodiment shown in FIG. 4, there is no non-metallic frame 44 positioned over the second portion 72 of the ferromagnetic core 16. The metallic surround form 70 is formed of a non-ferrous material. In this embodiment, the metallic piece 74 joins the metallic surround form 70 to the ferromagnetic core 72.

As shown in the previous drawings, it has been found that the insulating material of the ignition coil 10 is more uniformly stressed between the ferromagnetic core 16 and the secondary winding 26. The non-ferrous metal form 34 is configured in a circular shape, or other shape, that surrounds a percentage of the ferromagnetic core and the inner barrel of the bobbin 28. This non-ferrous metal form 34 will extend in a longitudinal direction generally concentric with that of the second portion 22 of the ferromagnetic core 16. This form 34 can be isolated from or joined to the ferromagnetic core. This non-ferrous metal form 34 serves to diminish dense electrical fields and provide a more uniform flux density. The form 34 reduces the surface charge densities on the smaller radius areas of the ferromagnetic core. As such, the insulation material is more uniformly stressed. The form 34 is separated on one side so as to not be connected in a closed loop with itself As such, current cannot flow around the non-ferrous metal form 34. The present invention allows for increased potential voltages between the secondary side of the coil and the ferromagnetic core 16 that would normally result in an electrical breakdown between these assembly components. Sample testing has verified that this configuration can improve the coil's unloaded operating life expectancies to greater than ten times that of the same coil without the configuration.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An ignition coil comprising:

a ferromagnetic core;

a primary coil surrounding a first portion of said ferromagnetic core:

a secondary coil surrounding a second portion of said ferromagnetic core, said secondary coil being wrapped around a bobbin, said bobbin having an interior that receives the second portion of said ferromagnetic core therein; and a form interposed between said secondary coil and the second portion of said ferromagnetic core, said form extending longitudinally along the second portion of said ferromagnetic core, said form being of a non-ferrous metal, said form being of a generally tubular shape, said tubular shape having a split extending longitudinally therealong so as to interrupt a circularity of said tubular shape.

2. The ignition coil of claim 1, said form extending substantially along the entire length of said bobbin.

3. The ignition coil of claim 1, said bobbin having an inner wall facing the second portion of said ferromagnetic core, said form being affixed to said inner wall of said bobbin.

4. The ignition coil of claim 1, said form affixed to the second portion of said ferromagnetic core within the interior of said bobbin.

5. An ignition coil comprising;

a ferromagnetic core;

a primary coil surrounding a first portion of said ferromagnetic core;

a secondary coil surrounding a second portion of said ferromagnetic core, said secondary coil being wrapped around a bobbin, said bobbin having an interior that receives the second portion of said ferromagnetic core therein;

a form interposed between said secondary coil and the second portion of said ferromagnetic core, said form extending longitudinally along the second portion of said ferromagnetic core, said form being of a non-ferrous metal; and a frame affixed to an exterior of the second portion of said ferromagnetic core, said frame being of a non-metallic material.

6. The ignition coil of claim 1, said ferromagnetic core having a generally square or rectangular shape, said primary coil positioned on a side of said ferromagnetic core, said second coil positioned on opposite side of said ferromagnetic core.

7. The ignition coil of claim 1, further comprising:

a housing having an interior, said ferromagnetic core and said primary coil and said secondary coil and said form being received within the interior of said housing.

8. An ignition coil comprising;

a ferromagnetic core having a generally rectangular configuration;

a primary coil extending over one side of said ferromagnetic core;

a bobbin positioned over an opposite side of said ferromagnetic core, said bobbin having a plurality of bays therein, said bobbin having inner wall adjacent to the opposite side of said ferromagnetic core;

a second coil received in said plurality of bays of said bobbin; and a form interposed between said secondary coil and the opposite side of said ferromagnetic core, said form being of a non-ferrous metallic material, said form being of a generally tubular shape, said tubular shape having a split extending longitudinally therealong so as to interrupt a circularity of said tubular shape.

9. The ignition coil of claim 8, said form extending substantially along an entire length of said bobbin.

10. The ignition coil of claim 8, said bobbin having an inner wall facing the opposite side of said ferromagnetic core, said form being affixed to an inner wall of said bobbin.

11. The ignition coil of claim 8, said form being affixed to the opposite side of said ferromagnetic core and within an interior of said bobbin.

12. The ignition coil of claim 8, further comprising:

a frame affixed to an exterior of the opposite side of said ferromagnetic core, said frame being of a non-metallic material.

13. The ignition coil of claim 8, further comprising:

a housing having an interior, said ferromagnetic core and said primary coil and said secondary coil and said bobbin being received within the interior of said housing.

14. The ignition coil of claim 8, said form extending longitudinally in concentric relation with said opposite side of said ferromagnetic core.

* * * * *